US006921422B2

(12) United States Patent
Cook et al.

(10) Patent No.: US 6,921,422 B2
(45) Date of Patent: Jul. 26, 2005

(54) DUCTILE BINDER PHASE FOR USE WITH A1MGB$_{14}$ AND OTHER HARD MATERIALS

(75) Inventors: Bruce A. Cook, Ankeny, IA (US); Alan Russell, Ames, IA (US); Joel Harringa, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 13 days.

(21) Appl. No.: 10/669,183

(22) Filed: Sep. 23, 2003

(65) Prior Publication Data

US 2004/0134310 A1 Jul. 15, 2004

Related U.S. Application Data

(60) Provisional application No. 60/422,001, filed on Oct. 29, 2002.

(51) Int. Cl.[7] ..... C22C 29/00; C22C 29/14; C09K 3/14

(52) U.S. Cl. ..... 51/307; 51/308; 51/309; 75/235; 75/236; 75/240; 75/230; 419/10; 419/12; 419/13; 419/14; 419/19; 420/434; 420/435

(58) Field of Search ..... 51/307, 308, 309; 75/235, 236, 240, 230; 428/552; 420/434, 435; 419/10, 12, 13, 14, 19

(56) References Cited

U.S. PATENT DOCUMENTS 4,497,660 A * 2/1985 Lindholm ..... 75/240
4,990,410 A * 2/1991 Saitoh et al. ..... 428/547
6,030,429 A * 2/2000 Yamazaki et al. ..... 75/244
6,099,605 A 8/2000 Cook et al.
6,214,079 B1 * 4/2001 Kear et al. ..... 75/230
6,432,855 B1 8/2002 Cook et al.

FOREIGN PATENT DOCUMENTS

JP 2003-128466 5/2003
JP 2003-192441 7/2003

OTHER PUBLICATIONS

Y. Tian et al., Microstructure and nanomechanical properties of A1–Mg–B–Ti films synthesized by pulsed laser deposition, Thin Solid Films 418 (2002) 129–135, (no month).
Ram Cherukuri et al., Pulsed laser deposition of A1MgB$_{14}$ on carbide inserts for metal cutting, Surface and Coatings Technology 155 (2002) 112–120, (no month).
Y. Tian et al., Microstructure Evolution of A1–Mg–B Thin Films by Thermal Annealing, Journal of Vacuum Science & Technology, vol. 21 (4), pp. 1055–1063, 2003, (no month).
Ram Cherukuri and Pal Molian, Lathe Turning of Titanium Using Pulsed Laser Deposited, Ultra–Hard Boride Coatings of Carbide Inserts, Machine Science and Technology, vol. 7, No. 1, pp. 119–135, 2003, (no month).
B. A. Cook, et al., A New Class of Ultra–Hard Materials Based On A1MgB$_{14}$, Scripta mater, 42(2000) 597–602, (no month).

* cited by examiner

*Primary Examiner*—Michael Marcheschi
(74) *Attorney, Agent, or Firm*—McKee Voorhees & Sease, P.L.C.

(57) ABSTRACT

This invention relates to a ductile binder phase for use with AlMgB$_{14}$ and other hard materials. The ductile binder phase, a cobalt-manganese alloy, is used in appropriate quantities to tailor good hardness and reasonable fracture toughness for hard materials so they can be used suitably in industrial machining and grinding applications.

4 Claims, 3 Drawing Sheets

DUCTILE BINDER PHASE FOR USE WITH A1MGB$_{14}$ AND OTHER HARD MATERIALS

CROSS-REFERENCE TO RELATED APPLICATIONS

This application is based on U.S. patent application Ser. No. 60/422,001, filed Oct. 29, 2002 of which is herein incorporated by reference in its entirety.

GRANT REFERENCE

This research was federally funded under DOE Contract No. W-7405-ENG-82. The government may have certain rights in this invention.

FIELD OF THE INVENTION

The field of the invention involves a fracture resistant binder phase for use with ultra-hard AlMgB$_{14}$ superabrasive material and other hard materials.

BACKGROUND OF THE INVENTION

This invention partially relates to an improvement on our prior patents, U.S. Pat. No. 6,099,605 and its division, U.S. Pat. No. 6,432,855; the first issued Aug. 8, 2000 and the second Aug. 13, 2002. Those patents relate to a ceramic material which is an orthorhombic boride of the general formula: AlMgB$_{14}$. Crystallographic studies indicate that the metal sites are not fully occupied in the lattice so that the true chemical formula may be closer to $Al_{0.75}Mg_{0.78}B_{14}$ which is contemplated by the formula here used as AlMgB$_{14}$. The ceramic is a superabrasive, and in most instances provides a hardness of 30 GPa or greater. This invention relates to an improvement, involving the use of a binder phase to modify properties of AlMgB$_{14}$ and other hard materials for certain uses such as machine tools.

Advanced machining tools must possess both good hardness and reasonable fracture toughness, where hardness is defined as resistance to plastic indentation and toughness is a measure of a material's ability to absorb an impact without catastrophic fracture. Tungsten carbide (WC) for example is moderately hard but quite brittle; addition of cobalt as a binder phase enables monolithic tools fashioned from this material to better tolerate impacts such as those encountered during discontinuous cutting that would otherwise result in fracture and loss of the tool. The WC/Co composite is therefore characterized as a hard and brittle material dispersed in a continuous ductile matrix. The present invention involves discovery of a binder phase for AlMgB$_{14}$ and other hard materials.

Recent efforts to develop the ultra-hard AlMgB$_{14}$ into a next-generation cutting tool have motivated studies into the fracture resistance of this material and in possible binder phase additions. For a binder to be compatible, it must exist as a liquid phase within a temperature range that avoids undesirable decomposition of the active material, while also possessing a similar (or lower) surface energy to enable good "wetting" of each grain. Furthermore, the binder must possess sufficient ductility to absorb and dissipate the energy associated with an advancing crack tip, while retaining adequate strength to prevent failure under typical tensile, torsional, or shear loading. Several requirements exist for liquid phase sintering. First, the temperature must be sufficiently high so that the binder phase becomes completely liquid. A favorable contact angle must exist between the liquid binder phase and the solid base material. In other words, the relative surface energies of the two phases must be sufficiently low so that the liquid "wets" or completely covers each hard particle. Moreover, an appropriate volume fraction of binder phase must be present. In the case of insufficient quantity of binder, the tool may contain excessive porosity and lack mechanical strength. In the case of excessive amounts of binder phase, the mechanical properties of the tool will be determined primarily by the binder itself rather than that of the harder base material. In addition, excessive binder can result in liquid phase "squeeze-out" during sintering and undesired shape changes.

A consolidation temperature of 1400° C., as applied to the AlMgB$_{14}$ materials, precludes use of conventional binder metals such as nickel and cobalt, which melt at temperatures of 1453° C. and 1495° C., respectively. Consequently, an alternative binder metal was sought with a constraint that its freezing range should lie between 1380° C. and 1400° C.

It is therefore a primary object of the present invention to develop a suitable binder phase for use with ultra-hard AlMgB$_{14}$ and other hard materials.

Another object of the present invention is to develop a binder phase which "wets" or completely covers each hard particle of AlMgB$_{14}$ or other hard materials.

Yet another object of the present invention is to provide a binder phase for AlMgB$_{14}$ and other hard materials which can be used in appropriate quantities to tailor good hardness and reasonable fracture toughness for AlMgB$_{14}$ and other hard materials so that they can be used suitably in industrial machining and grinding applications.

The method and means of accomplishing these and other objectives of the invention will become apparent from the written description given below.

SUMMARY OF THE INVENTION

The invention is a superabrasive alloy comprising AlMgB$_{14}$ or another hard material in combination with ductile phase binder of cobalt-manganese (Co—Mn) alloy and a method of making same. More detail of the alloy ductile binder phase combination is provided in the written description below.

DETAILED DESCRIPTION OF A PREFERRED EMBODIMENT

Figure 1:
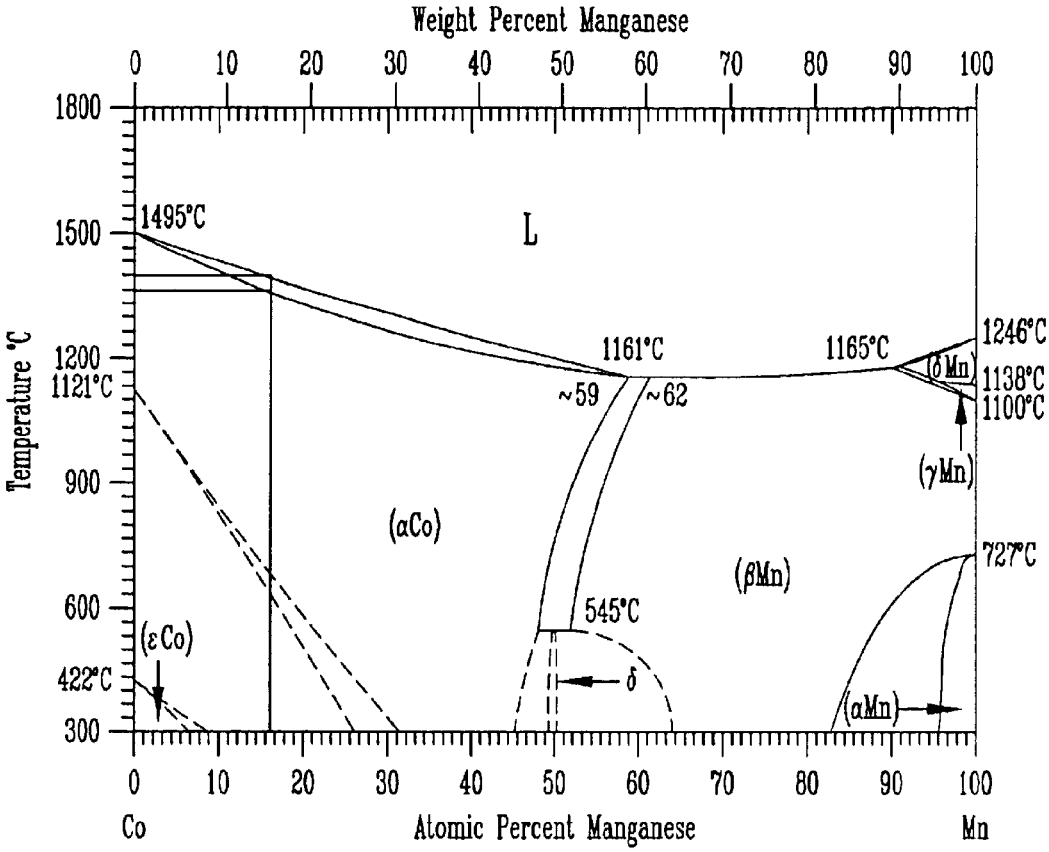
FIG. 1 is a binary cobalt-manganese phase diagram.

The disclosure of our previous U.S. Pat. No. 6,099,605 issued Aug. 8, 2000 is incorporated herein by reference, in all respects. The basic ceramic material used is an orthorhombic boride of AlMgB$_{14}$. The particulars of this alloy need not therefore be described in detail herein since it is described in our earlier U.S. Pat. No. 6,099,605.

An AlMgB$_{14}$-based alloy includes AlMgB$_{14}$, $Al_zSi_{1-z}MgB_{14}$, $AlCr_zMg_{1-z}B_{14}$, $AlTi_zMg_{1-z}B_{14}$ and AlMgB$_{14}$X where X is present in an amount of from 5 wt. % to 30 wt. % and comprises a doping agent from the group consisting of Group III, IV and V elements and borides and nitrides thereof and where $1 \geqq z \geqq 0$. Other hard materials for use in the invention include BN (cubic), SiC, $Al_{12}O_3$, $TiB_2$, WC, TiC, $AlB_{12}$ and $Si_3N_4$.

Efforts to develop next-generation ultra-hard materials with desirable properties such as high temperature oxidation resistance have resulted in a new, previously unknown compound, aluminum chromium boride, $AlCrB_{14}$. Theoretical prediction of the existence of this alloy was arrived at by combining alloy theory with recent computational calculations of the binding energies of the various components in $AlMgB_{14}$, which suggest that the Mg atoms are only weakly bound to the icosahedral framework. Since chromium forms a beneficial, protective oxide scale when exposed to a high temperature oxidizing environments, this new alloy may possess vastly improved oxidation resistance compared with $AlMgB_{14}$. Moreover, the comparatively low vapor pressure of chromium relative to magnesium may ameliorate some of the processing difficulties encountered during synthesis of the alloy.

Chromium can either fully or partially replace magnesium atoms in the $AlMgB_{14}$ structure. Complete substitution of Cr for Mg results in the ternary compound $AlCrB_{14}$, whereas partial substitution is denoted by the formula $AlCr_xMg_{1-x}B_{14}$, where x can assume any real value from 0 to 1.

Preparation of $AlCrB_{14}$ consists of weighing out the stoichiometric quantities of components (elemental Al, Cr, and B or the binary constituents $AlB_{12}$ and $CrB_2$). This is typically performed in a low-oxygen glove box to minimize oxygen contamination. The components are mechanically alloyed to form a nanophase product, which is then hot pressed to form a dense article. Depending on hot pressing conditions (temperature, pressure) the article may or may not possess the desired composition. A secondary annealing step may be required to complete the reaction. Similarly, preparation of the mixed composition, $AlCr_{1-x}Mg_xB_{14}$, is accomplished by weighing out the desired quantity of each component (elemental Al, Mg, Cr, and B) and mechanically alloying the mixture under inert gas. The nanophase powder is then hot pressed to form a dense article. Cr-lean compositions (i.e., $x<0.3$) do not require additional heat treatment to obtain the desired phase. However, Cr-rich compositions may require the secondary annealing step as described above. The present invention contemplates preparing $AlTi_zMg_{1-z}B_{14}$ via a similar route.

$Al_zSi_{1-z}MgB_{14}$ is different because it is the Al rather than the Mg that is substituted for. $Al_zSi_{1-z}MgB_{14}$ is made like $AlMgB_{14}$ only some Si powder replaces some Al powder.

Since no single element possesses the combination of high ductility, limited chemical reactivity with $AlMgB_{14}$, absence of phase transformation and a melting temperature of 1400° C., a search for an appropriate ductile binder phase metal that "wets" $AlMgB_{14}$ involved binary alloys. The optimum binary alloy was identified as that contained within the Co—Mn system selected. Upon investigation and testing a Co-17% (atomic) Mn alloy it was found to be satisfactory over a wide-range of additions on a present volume basis, and it did, in fact, "wet" the $AlMgB_{14}$. FIG. 1 shows a phase diagram for a cobalt-manganese system.

The Co—Mn system is ideally suited for use as a binder phase for grit with a melting temperature of 1400° C. Manganese exhibits extensive solid solubility in cobalt, and, other than a magnetic transformation in α-Co which is not expected to affect the cutting characteristics, exhibits no phase transformation between the solidus and room temperature. This is important because a crystallographic transformation can result in volumetric expansion or contraction, leading to separation of the active grit from the binder. Moreover, it is important to avoid the presence of intermetallic phases, common in binary phase diagrams, because of the inherently brittle nature of these phases. From FIG. 1, it can be seen that addition of approximately 17 atomic percent Mn to Co results in a single phase alloy with a freezing range between 1360° C. and 1400° C. It can also be seen from FIG. 1 that a mixture of pure Co and $AlMgB_{14}$ can not be hot pressed at 1400° C., resulting in simultaneous sintering of the boride and liquid formation in the continuous binder phase. For these reasons, the Co—Mn system was selected.

The amount of ductile binder phase of the cobalt-manganese alloy on a volumetric basis can be from about 5% to about 30%, preferably from about 10% to about 20%. Various amounts within these ranges may be used to tailor the desired fractured toughness/hardness/impact resistant combination of properties.

The preferred ductile binder phase from the standpoint of consolidation temperature of the $AlMgB_{14}$ is Co-17% (atomic) Mn. However, other compositions of cobalt/manganese alloy may be used as the binder phase with the compositions generally ranging from 5% to 45% manganese on an atomic basis.

In the examples described below, determinations of fracture toughness were made and compared with known materials. Typical fracture toughness determinations require fabrication to test specimens according to ASTM Standard E399-90 which are then fatigued to form an incipient crack of length also specified by ASTM Standard E399-90. The fracture toughness of the material can then be determined by breaking the specimen in tension and measuring the corresponding stress required for failure to occur. In the limiting case where the specimen thickness is significantly greater than any pre-existing internal crack, the appropriate parameter is plane strain fracture toughness, denoted $K_{IC}$.

The Palmqvist technique was employed to characterize fracture toughness. A plastic indentation is made in a smooth surface region of the material by a Vickers diamond indenter, which results in a characteristic crack pattern extending from the four corners; an inverse relationship exists between crack length and fracture toughness. The crack lengths are measured by optical microscopy and used to estimate fracture toughness.

For well developed cracks, where the crack length, c, is much greater than the indentation diagonal length, a, the plane strain fracture toughness may be estimated by:

$$K_{IC} = X\left(\frac{E}{H}\right)^{\frac{1}{2}}\left(\frac{P}{c^{\frac{3}{2}}}\right) \tag{1}$$

In the above equation, E is the elastic modulus, H is the Vickers Hardness (HP), and P is the applied load (N). X is a material constant, which has been shown to equal 0.016 in calibration studies with a number of materials. Table I shows the accepted values for plane strain fracture toughness for a number of materials.

TABLE I

Fracture Toughness of Selected Materials (22° C.)

| | $K_{IC}$ (MPa√m) |
|---|---|
| Aluminum oxide | 3.9 |
| Concrete | 0.2–1.4 |
| Diamond (natural) | 3.4 |
| Glass (borosilicate) | 0.8 |
| Silicon nitride (sintered) | 5.3 |
| Ti—6Al—4V | 44–66 |
| Aluminum Alloy (7075) | 24 |
| $B_4C$ | 3 |
| WC + Co | 7.5–8.9 |

As the table indicates, fracture toughness values for ceramic materials are inherently low, typically less than 4 MPa√m, whereas the more ductile metallic alloys tend to possess $K_{IC}$ values greater than 20 MPa√m. A reasonable goal for the $AlMgB_{14}$-based materials would be a $K_{IC}$ within the range of existing cemented carbide tools, or around 7 to 9 MPa√m.

The following example is offered to further illustrate but not limit the invention.

EXAMPLE

Boride samples for this study were prepared by mechanically alloying the elemental constituents in sealed vials, followed by hot consolidation of the sub-micron powder using either a uniaxial hot press or a hot isostatic press. Half-inch diameter disks were ground and polished using diamond-embedded steel grinding plates and 1-micron diamond grinding slurries. Micro hardness values were obtained using a Wilson-Tukon model 200 equipped with charged coupled device image enhancement capability, operated at a loading of 1000 g force. Standard samples of fully dense SiC and cubic-BN were measured with this hardness-testing unit and found to agree with published hardness values.

The binder alloy was prepared by arc melting the metal constituents to produce a homogeneous single-phase solid solution. After remelting several times, an ingot was cast on a water-cooled copper hearth. A portion of the arc-cast finger was machined into an appropriate geometry for tensile testing. Filings were also removed for characterization by x-ray diffraction.

Figure 2:
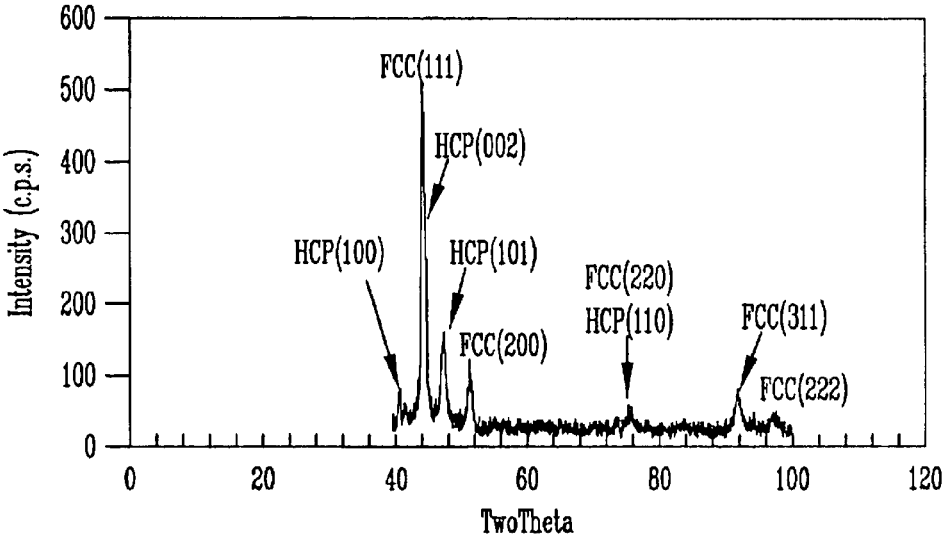
FIG. 2 is an x-ray diffraction pattern of a cobalt-17% (atomic) manganese phase binder material.

Hot pressed boride disks were ground by placing the sample into a hardened steel, round-ended vial and milled for 2 minutes. The resulting powder was blended with filings removed from the binder ingot to obtain the desired volume fraction. The mixture was placed into a boron nitride-lined graphite die and then cold pressed at 10 to 14 ksi. After cold pressing, the green body was sintered under flowing argon at 1380° C. for 5 minutes. A surface of the specimen was cleaned, polished, and the Vicker's microhardness was measured in the conventional manner. The fracture toughness was determined using equation (1). The elastic modulus was previously determined on a similar sample by ultrasonic techniques with an average value of 366 GPa, which was employed in these calculations. An x-ray diffraction pattern obtained on the filings from the master Co-17% (atomic) Mn ingot is shown in FIG. 2.

The x-ray pattern shows the presence of at least two phases; an HCP and FCC Co solid solution. This two-phase microstructure does not correspond to the equilibrium structure predicted by FIG. 1. A section of the as-cast finger was mounted, polished, and etched with 2% nital etchant to reveal a microstructure similar to that of the classic Widmanstatten structure, in which second phase plates are arranged along specific crystallographic orientations. While nonequilibrium solidification through the two phase liquid-plus-solid region normally result in dendritic segregation, the appearance in this case is not characteristic of the conventional "cored" microstructure resulting from such a process. Moreover, since the two-phase region itself is relatively narrow, one would not expect a significant volume fraction showing compositional variation.

Figure 3:
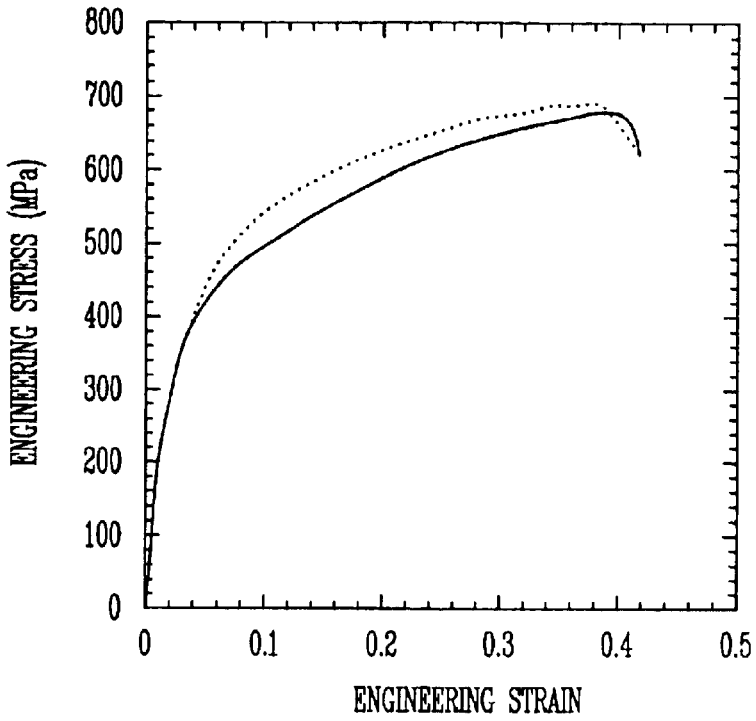
FIG. 3 is a stress-strain behavior graph of cobalt-17% (atomic) manganese alloy. Tensile strain rates were $5.0\times10^{-4}s^{-1}$ (solid Curve) and $1.2\times10^{-4}s^{-1}$ (broken line curve).

The mechanical deformation behavior of the Co-17% (atomic) Mn binder was evaluated by way of standard tensile test (ASTM E8) on samples machined from hot-waged rod. The resulting engineering stress strain plots are shown in FIG. 3, which indicate that the Co-17% (atomic) Mn alloy possess ultimate tensile strength of 670 MPa combined with unusually high ductility of 40% or more elongation. These values are presented in Table II in comparison with strength and ductility value from the literature for pure Co.

TABLE II

Room Temperature Ultimate Tensile Strength and Ductility of Co-17% Mn (atomic) and Co-38% (atomic) Mn Compared to Literature Values for Pure Co.

| | Ultimate Tensile Strength (MPa) | Ductility (elongation) | Ductility (reduction in area) |
|---|---|---|---|
| Co-17% (atomic) Mn: Tensile Specimen (strain rate $5(10^{-4})s^{-1}$) | 675 | 42% | 40% |
| Co-17% (atomic) Mn: Tensile Specimen (strain rate $1.2(10^{-4})s^{-1}$) | 685 | 40% | 52% |
| Co-38% (atomic) Mn: Tensile Specimen (strain rate $4 \times 10^{-4}s^{-1}$) | 620 | 40% | 54% |
| *Co, 99.9% purity, as-cast | 235 | 4% | NA |
| *Co, 99.9% purity, annealed | 255 | 8% | NA |
| *Co, 99.6% purity, cold-worked | 690 | 8% | NA |
| *Co, 99.6% purity | 690 | 14% | 16% |
| *Co, 99.5% purity, hot worked then annealed at 800° to 1000° C. | 800 to 875 | 15% to 30% | NA |

*The Co data from the above table is from W. Betteridge, "Cobalt and Its Alloys", John Wiley & Sons, 1982, p. 24 and R. S. Young, "Cobalt: Its Chemistry, Metallurgy and its Uses", Reinhold Publishing, 1960, p. 68.

Figure 4:
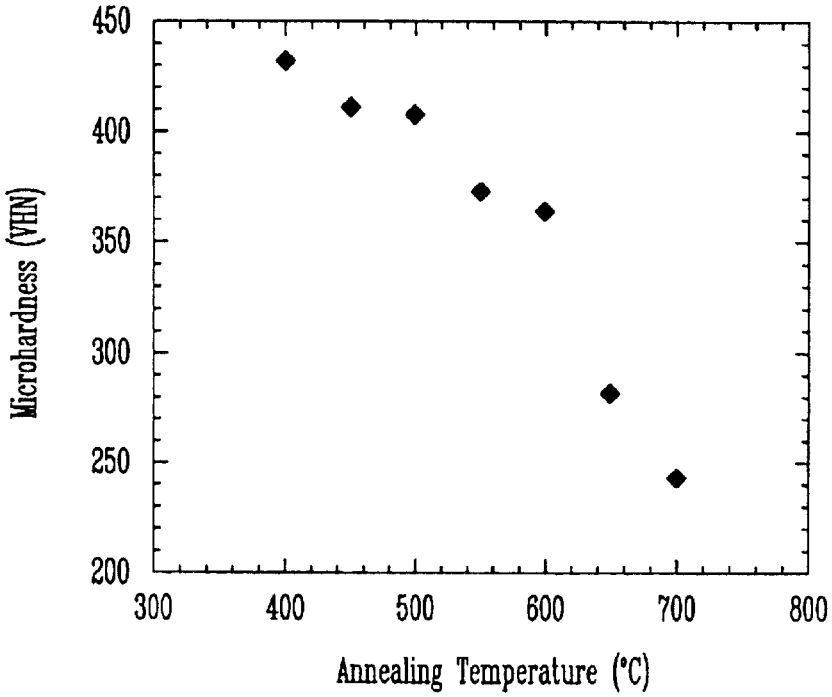
FIG. 4 is the result of recrystallization measurements on cold-worked Co-17% Mn (atomic) showing that the apparent recrystallization temperature is ≈620° C.

The recrystallization study on cold-worked Co-17% (atomic) Mn indicated that the alloy recrystallized at ≈620° C. as shown in FIG. 4.

Figure 5A:
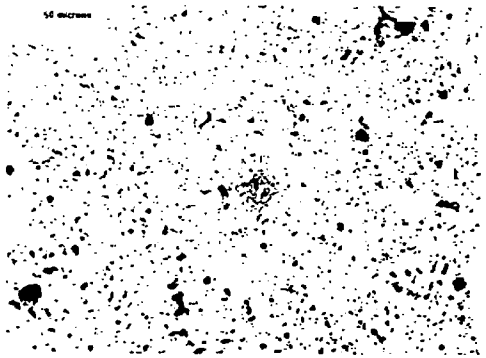
FIG. 5 is a typical 1000 g indentation impression in reference SiC (A), baseline boride (B), in boride containing 5 (C) and 20 (D) volume percent binder phase.
Figure 5B:
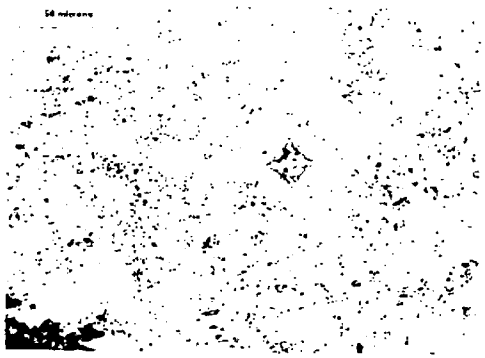
Figure 5C:
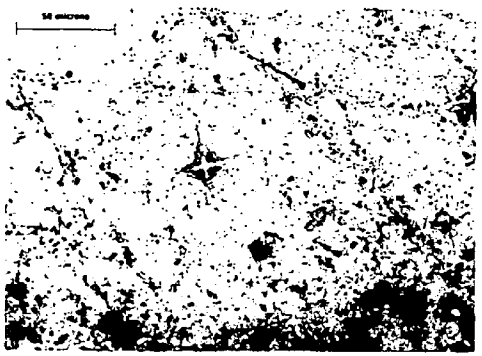
Figure 5D:
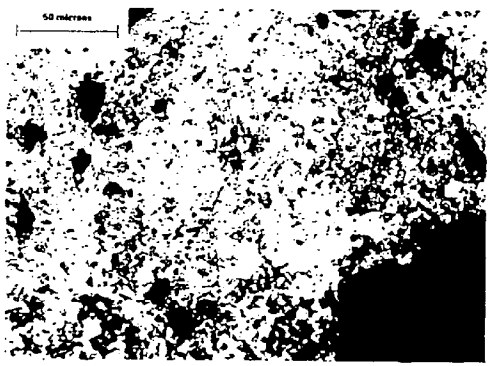

$K_{IC}$ values (as determined by the Palmqvist method) of a SiC specimen and of the borides are shown in Table III. Typical indentation impressions in the SiC and baseline boride (without binder) are shown in FIGS. 5A and 5B, respectively. Since the literature value for SiC is 3.1 MPa√m, agreement with the measured toughness values is considered acceptable. Indentation impressions in the specimens containing 5 weight % and 20 weight % binder are shown in FIGS. 5C and 5D, respectively. Hardness values for the various samples were found to vary with the amount of binder present, as expected. Thus, an average value was used during the $K_{IC}$ calculations. These hardness values are shown in Table III.

TABLE III

Hardness and Fracture Toughness as Estimated by the Palmqvist Technique (1000 gram load)

| Material | Hardness (GPa) | $K_{IC}$ (MPa√m) |
|---|---|---|
| SiC | 23 | 3.0 |
| WC/Co | 22–13 | 5–15 |
| $AlMgB_{14}$ (baseline) | 29 | 4.8–6.7 |
| $AlMgB_{14}$ + 5 vol % binder | 26 | 4.2–6.3 |
| $AlMgB_{14}$ + 20 vol % binder | 21 | 6.6–8.5 |

Hardness and fracture toughness of WC/Co depends strongly on the amount of Co present. Typical amounts of Co range from 6 to 30 volume percent, preferably 6 to 20% vol. %.

The baseline boride, $AlMgB_{14}$, was found to possess good fracture toughness for a ceramic material. Results from the 5 volume percent binder phase (Co-17% (atomic) Mn) specimen were somewhat inconclusive, primarily because the distribution of binder was not uniform; distinct and separate regions of boride and binder were observed, with relatively few well-intermixed areas. Results from the 20 volume percent binder specimen were much less ambiguous. A clear indication of improvement in fracture toughness was observed, for the case in which the binder phase was uniformly distributed.

An example of an indentation and corresponding crack pattern resulting from a 1000 gram-force load on a baseline $AlMgB_{14}$ specimen is shown in FIG. 5. Results of this example show that the Co-17% (atomic) Mn binder phase is compatible with the boride material, meaning that the binder becomes liquid at the hot pressing temperature without adversely affecting the boride. Preliminary indications are that the surface energies of the two phases are comparable, so that the liquid binder "wets" the boride, rather than forming discrete spherical phases. This uniform coating morphology is critical to implementation of the binder in industrial machining and grinding applications. It was observed that the binder phase increased the fracture toughness of the $AlMgB_{14}$.

The above example is offered as illustrative only and is not intended to be limiting but instead merely a written description of a preferred embodiment.

What is claimed is:

1. An abrasive alloy comprising $AlMgB_{14}X$ where X is present in an amount of from 5 wt. % to 30 wt. % and comprises a doping agent from the group consisting of Group III, IV, V elements and borides and nitrides thereof with a hardness over 20 GPa in combination with from about 5 vol. % to about 30 vol. % of a ductile binder phase of Co—Mn alloy.

2. The abrasive alloy of claim 1 wherein the ductile binder phase is present in an amount of from about 10 vol. % to about 20 vol. %.

3. The abrasive alloy of claim 1 wherein the ductile binder phase of Co—Mn alloy ranges from 5% to 45% Mn on an atomic weight basis.

4. The abrasive alloy of claim 3 wherein in the ductile binder phase of Co—Mn alloy Mn is present in an amount of between 17% (atomic) to 38% (atomic).

* * * * *

UNITED STATES PATENT AND TRADEMARK OFFICE

CERTIFICATE OF CORRECTION

PATENT NO. : 6,921,422 B2
DATED : July 26, 2005
INVENTOR(S) : Cook et al.

It is certified that error appears in the above-identified patent and that said Letters Patent is hereby corrected as shown below:

Column 1,
Lines 12-14, insert the following:
-- This research was federally funded under DOE Contract No. W-7405-ENG-82 and NSF Grant No. CMS-0307094. The government may have certain rights in this invention. --.

Signed and Sealed this

Twentieth Day of September, 2005

JON W. DUDAS
*Director of the United States Patent and Trademark Office*